US007600556B2

(12) United States Patent
Koyama et al.

(10) Patent No.: US 7,600,556 B2
(45) Date of Patent: Oct. 13, 2009

(54) MOLD FOR CASTING AND METHOD OF SURFACE TREATMENT THEREOF

(75) Inventors: Hiroaki Koyama, Tochigi-ken (JP); Yasuhiro Shimamura, Utsunomiya (JP); Toshihiro Miyauchi, Tochigi-ken (JP); Michiharu Hasegawa, Mie-ken (JP); Fumitaka Miyagawa, Kumamoto-ken (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/532,693

(22) PCT Filed: Oct. 28, 2003

(86) PCT No.: PCT/JP03/13757

§ 371 (c)(1),
(2), (4) Date: Jan. 3, 2006

(87) PCT Pub. No.: WO2004/039517

PCT Pub. Date: May 13, 2004

(65) Prior Publication Data

US 2006/0201650 A1 Sep. 14, 2006

(30) Foreign Application Priority Data

Oct. 30, 2002 (JP) ..... 2002-316632

(51) Int. Cl.
*B22D 17/22* (2006.01)

(52) U.S. Cl. ..... 164/113; 164/138; 164/312

(58) Field of Classification Search ..... 164/72, 164/113, 138, 306, 312
See application file for complete search history.

(56) References Cited

U.S. PATENT DOCUMENTS 4,762,163 A * 8/1988 Takehisa et al. ..... 164/72
6,546,968 B2 * 4/2003 Nakagawa et al. ..... 140/104

FOREIGN PATENT DOCUMENTS

| | | |
|---|---|---|
| JP | 08-144039 | 6/1996 |
| JP | 10-204610 | 8/1998 |
| JP | 11152583 | 6/1999 |
| JP | 11197762 | 7/1999 |
| JP | 2000038653 | 2/2000 |
| JP | 2001011599 | 1/2001 |
| JP | 2002-060845 | 2/2002 |

* cited by examiner

*Primary Examiner*—Kuang Lin
(74) *Attorney, Agent, or Firm*—Carrier, Blackman & Associates, P.C.; Joseph P. Carrier; William D. Blackman

(57) ABSTRACT

A method of the surface treatment of a mold for casting, which comprises subjecting a cavity surface of a fixed mold made by the use of a SCM420 material to first shot peening, a sulfurizing-nitriding treatment and second shot peening. The resulting cavity surface of the fixed mold exhibits a high hardness of 700 or higher in terms of Vickers hardness due to the presence of a sulfurized and nitrided layer, and further has a compression residual stress of more than 1200 Mpa and a largest height, which is a surface roughness value defined by JIS standard, of 8 μm or less.

15 Claims, 3 Drawing Sheets

MOLD FOR CASTING AND METHOD OF SURFACE TREATMENT THEREOF

TECHNICAL FIELD

The present invention relates to a casting die and a surface treatment method of the same. In particular, the present invention relates to a casting die which makes it possible to decrease replacement frequency to be as low as possible because of a long service life and which makes it possible to reduce the production cost of cast products thereby, and a surface treatment method of the same.

BACKGROUND ART

When a cast product such as a member made of aluminum is manufactured by casting operation, molten metal of aluminum is supplied into a casting die. A material of SKD61 (Japanese Industrial Standard for representing an alloy tool steel), which is excellent in strength at high temperatures, is generally adopted as a material for the casting die, because the molten metal has a high temperature.

When a heat crack and/or chipping appears in the casting die, it is difficult to obtain the member made of aluminum at a predetermined dimensional accuracy. That is, the production yield of the member made of aluminum is disadvantageously lowered. The casting die, in which the heat crack and/or the chipping appears, is replaced with a new one. However, if the replacement frequency is increased, the production cost of the member made of aluminum becomes expensive, because the casting die is generally expensive.

The heat crack is caused, for example, by a rapid change in temperature when the high temperature molten metal contacts the casting die, i.e., by thermal shock. On the other hand, the chipping is caused, for example, by cutting a soft surface layer with the member made of aluminum when the member made of aluminum is taken out from the casting die after the completion of the casting operation. Therefore, it is desirable that both of the thermal shock resistance and the hardness of the casting die are high.

Therefore, a surface treatment is usually applied to the casting die. Specifically, the surface treatment includes nitriding treatment such as the salt bath method, the gas method, and the ion method; coating treatment in which a ceramic material such as TiC and TiN is coated by means of the physical vapor deposition (PVD) method or the chemical vapor deposition (CVD) method; sulphonitriding treatment in which a mixture layer of iron sulfide and iron nitride is provided; and oxidizing treatment in which iron oxide is provided. It is also suggested in Japanese Laid-Open Patent Publication Nos. 8-144039 and 10-204610 that a plurality of treatment methods such as the nitriding treatment, the carburizing treatment, and the boronizing treatment are combined.

In recent years, the improvement of the thermal shock resistance and the hardness of the casting die is tried so that the replacement frequency of the casting die is reduced in order to reduce the production cost of cast products. However, for example, when the casting die, which is applied with the plurality of treatments as suggested in Japanese Laid-Open Patent Publication Nos. 8-144039 and 10-204610, is used, the replacement frequency is reduced to some extent as compared with a case in which a casting die applied with only the nitriding treatment is used. However, the production cost is not remarkably reduced.

It is also conceived that a material of SCM (Japanese Industrial Standard for representing one of chrome molybdenum steels), which is more inexpensive, is used as an alternative material to constitute a casting die, because the material of SKD is generally expensive. However, even when a variety of surface treatments as described above are applied to a casting die of the SCM material, it is impossible to sufficiently improve the thermal shock resistance and the hardness. Consequently, obtained casting dies do not have necessary service lives in many cases.

SUMMARY OF THE INVENTION

The present inventors have investigated the cause of the appearance of the heat crack in the casting die, and directed the attention to a known property that the heat crack tends to appear when the tensile stress, which acts on the casting die when the molten metal is supplied, exceeds the compressive residual stress remaining in the casting die. From this viewpoint, the service life of the casting die is tried to be prolonged by previously applying a large compressive residual stress to the casting die and making the tensile stress acting on the casting die smaller than the compressive residual stress.

A method capable of increasing the compressive residual stress may include shot peening treatment by way of example. However, even when the shot peening treatment is merely applied to the casting die, it is impossible to remarkably reduce the production cost of the cast product, although the appearance of the heat crack is prevented.

Accordingly, the present inventors have made further investigation about a technique to apply a large compressive residual stress. Thus, the present invention has been completed.

A principal object of the present invention is to provide a casting die which makes it possible to decrease the replacement frequency to be as low as possible and which makes it possible to remarkably reduce the production cost of cast products, and a surface treatment method of the same.

According to one aspect of the present invention, there is provided a casting die of a steel material, wherein a compressive residual stress of a cavity surface is larger than 1000 MPa, a maximum height is not more than 16 μm, and a nitrided layer is provided at a surface layer of the cavity surface.

The term "cavity surface" refers to a surface for forming a cavity to manufacture a cast product. The term "maximum height" is a surface roughness as defined by Japanese Industrial Standard.

Usually, the compressive residual stress, which remains in a casting die manufactured from a material, is merely about 200 MPa. Even when the shot peening treatment is applied, the compressive residual stress is about 500 MPa. In contrast, in the case of the casting die of the present invention, the compressive residual stress of the cavity surface is remarkably large, i.e., 1000 MPa. Therefore, even when any tensile stress is exerted by the thermal shock when the casting die contacts the molten metal, the tensile stress is prevented from exceeding the compressive residual stress. Therefore, the heat crack in the casting die is prevented. In other words, the thermal shock resistance of the casting die is remarkably improved.

Further, in the present invention, the nitrided layer exists at the cavity surface. Therefore, the reaction between the cavity surface and the molten metal is prevented. Further, the nitrided layer is hard, because the nitrided layer is composed of iron nitride. Therefore, the cavity surface is hard. Accordingly, the cavity surface is prevented from being cut by the cast product when the cast product is taken out after the completion of the casting operation.

That is, the heat crack is hardly caused in the casting die of the present invention, and the casting die of the present invention is hardly cut as well. In other words, the casting die of the present invention has high durability and a long service life. Accordingly, the replacement frequency is decreased to be as low as possible. Consequently, it is possible to remarkably reduce the production cost of the cast product.

A shot peening treatment is applied to the casting die at least once. Therefore, the maximum height of the surface is not more than 16 μm.

Preferred examples of the steel material for the casting die include alloy tool steel (SKD material as defined in Japanese Industrial Standard). In this case, it is preferable that a thickness of the nitrided layer is not less than 0.03 mm, and a Vickers hardness of the cavity surface is not less than 700.

As another preferred example of the steel material, there is exemplified chrome molybdenum steel (SCM material as defined in Japanese Industrial Standard). Also in this case, it is preferable that the Vickers hardness of the cavity surface is not less than 700. The SCM material is softer than the SKD material. Therefore, the thickness of the nitrided layer is not less than 0.1 mm in order that the Vickers hardness is not less than 700.

The shot peening treatment may be applied twice to the casting die of the present invention as described later on. In this case, the maximum height of the cavity surface is not more than 8 μm, and the compressive residual stress is larger than 1200 MPa. Accordingly, the casting die is more excellent in durability.

It is preferable that iron sulfide is contained in the nitrided layer. When the iron sulfide is present, lubrication is added. Therefore, the frictional resistance between the cast product and the casting die is decreased when the cast product is taken out. Accordingly, it is possible to avoid any chipping of the casting die as well.

Further, in this case, the value of the compressive residual stress is further increased. Therefore, the durability of the casting die is further improved. Consequently, it is possible to further reduce the production cost of the cast product.

According to another aspect of the present invention, there is provided a surface treatment method of a casting die of a steel material, comprising applying a shot peening treatment and a nitriding treatment to at least a cavity surface of the casting die so that a maximum height of the cavity surface is not more than 16 μm, and a compressive residual stress is larger than 1000 MPa.

When the shot peening treatment and the nitriding treatment are applied to the cavity surface of the casting die, it is possible to obtain the casting die provided with the cavity surface in which the compressive residual stress is extremely large and the hardness is high. As described above, such a casting die is excellent in durability. Therefore, the casting die has a long service life.

The shot peening treatment may be performed earlier than the nitriding treatment, and vise versa. However, it is preferable that the shot peening treatment is performed earlier. In this case, the cavity surface is smoothened by the shot peening treatment. Further, the compressive stress is applied to the cavity surface. Therefore, the nitrogen atom and the sulfur atom are bonded to Fe with ease in the sulphonitriding treatment.

When the shot peening treatment is performed earlier, it is preferable that the shot peening treatment is performed again after applying the nitriding treatment so that the maximum height of the cavity surface is not more than 8 μm, and the compressive residual stress is larger than 1200 MPa. Accordingly, it is possible to obtain the casting die which is more satisfactory in durability.

When a sulphonitriding treatment or a gas nitriding treatment on the use of nitriding gas is adopted as the nitriding treatment, it is possible to further raise the compressive residual stress remaining in the casting die. In particular, in the case of the sulphonitriding treatment, the lubrication can be added to the cavity surface by allowing the nitrided layer to contain iron sulfide.

The surface treatment method of the present invention can be applied not only to the casting die which is not used for the casting operation but also to the casting die which has been used for the casting operation. In this case, the compressive residual stress, which has been lowered due to the repeated use in the casting operation, can be increased again. That is, the durability is applied to the casting die again, and it is possible to avoid the occurrence of the heat crack or the like. Therefore, it is possible to further prolong the service life of the casting die.

The above and other objects, features, and advantages of the present invention will become more apparent from the following description when taken in conjunction with the accompanying drawings in which a preferred embodiment of the present invention is shown by way of illustrative example.

DETAILED DESCRIPTION OF BEST MODE FOR CARRYING OUT THE INVENTION

The casting die of the present invention and the surface treatment method thereof will be explained in detail below with reference to the accompanying drawings as exemplified by preferred embodiments.

Figure 1:
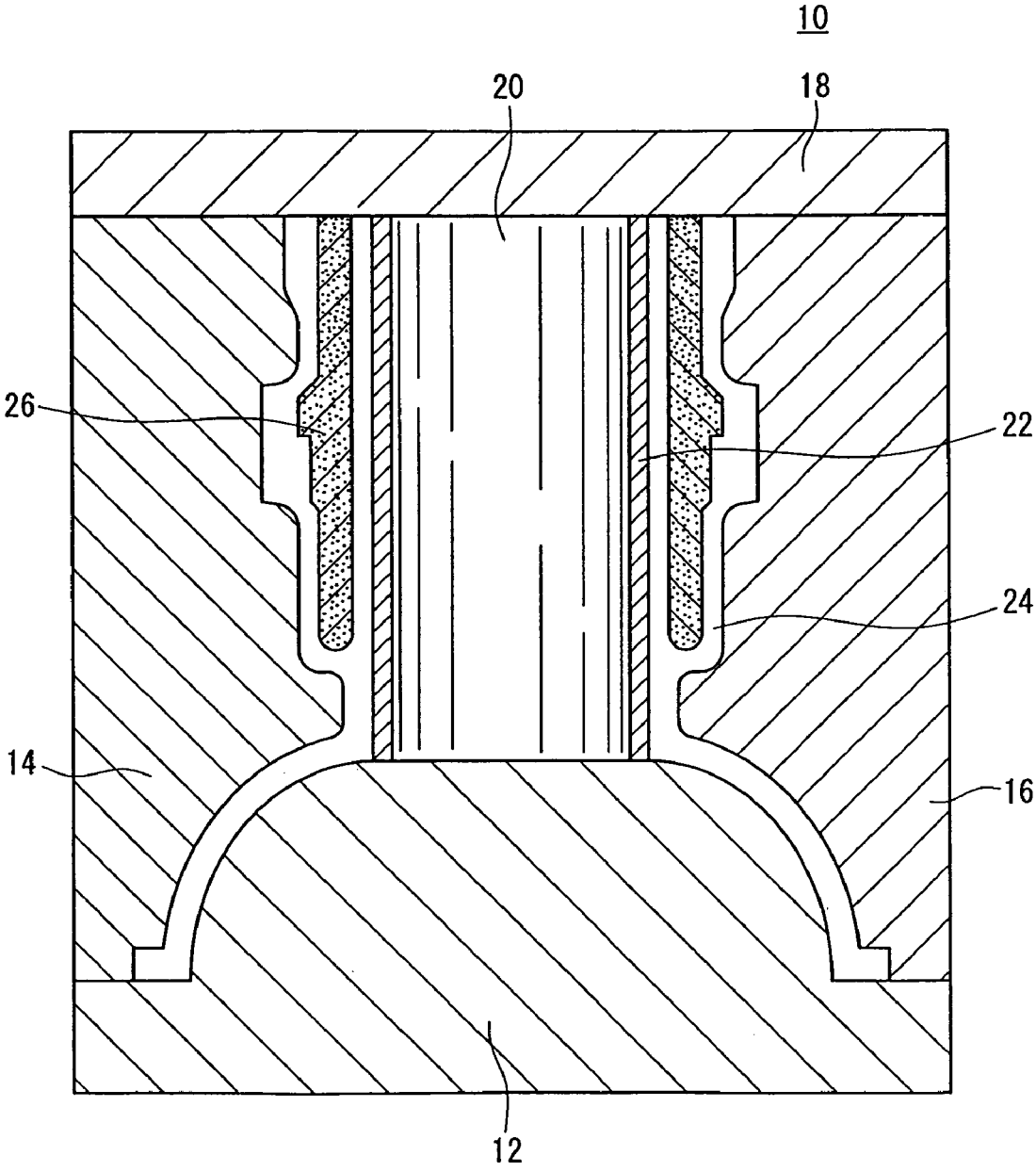
FIG. 1 is a vertical sectional view illustrating major parts of a casting apparatus provided with a casting die according to an embodiment of the present invention.

FIG. 1 is a schematic vertical sectional view illustrating a casting apparatus provided with a casting die according to an embodiment of the present invention. The casting apparatus 10 is usable to cast an unillustrated cylinder block as a cast product of aluminum. The casting apparatus 10 comprises casting dies, i.e., a fixed die 12, side movable dies 14, 16, and an upper movable die 18. In particular, the fixed die 12 is provided with a bore pin 20. A sleeve 22 is externally installed to the bore pin 20, and thus a cavity 24 for obtaining the cylinder block is formed in the casting apparatus.

A sand-core 26, which is provided to form a water jacket of the cylinder block, is arranged in the cavity 24. The sand-core 26 is supported by an unillustrated support member.

Figure 2:
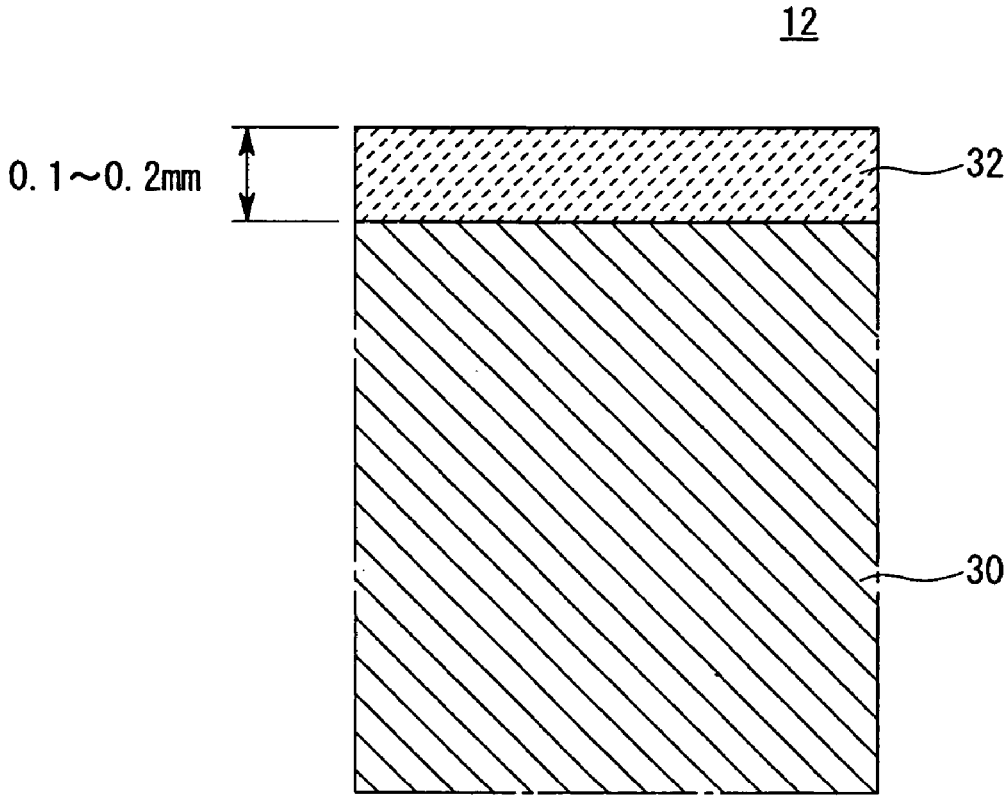
FIG. 2 is a magnified view illustrating major parts of a cavity surface of a fixed die of the casting apparatus shown in FIG. 1.

Each of the fixed die 12, the side movable dies 14, 16, and the upper movable die 18 has a base material layer of a steel material represented as SCM420 by Japanese Industrial Standard. As shown in FIG. 2, a sulphonitrided layer 32, which is formed on the base material layer 30 of the SCM420 material, is present at the cavity surface of each of the dies 12, 14, 16, 18. The sulphonitrided layer 32 is a diffusion layer obtained by diffusing, in the base material layer 30, the sulfur atom and the nitrogen atom originating from a sulfurizing gas and a nitriding gas simultaneously supplied to the base material layer 30 as described later on. The sulphonitrided layer 32 contains a nitrided layer and iron sulfide.

The iron nitride contained in the sulphonitrided layer 32 improves the hardness of the SCM420 material (fixed die 12). That is, if the sulphonitrided layer 32 exists, the cavity surface of the fixed die 12 has high hardness. Specifically, the cavity surface exhibits a Vickers hardness of about 700.

The iron sulfide contained in the sulphonitrided layer 32 is a component for applying lubrication performance to the fixed die 12. In other words, the lubrication performance of the fixed die 12 is remarkably improved owing to the presence of the iron sulfide. As a result, it is possible to prevent the occurrence of scuffing or galling.

The thickness of the sulphonitrided layer 32 is preferably not less than 0.1 mm in order to give the sufficient hardness to the surface layer portion and the cavity surface of the fixed die 12, because the SCM420 material as the material of the fixed die 12 is soft. In order to give the sufficient hardness to the fixed die 12, it is sufficient that the thickness of the sulphonitrided layer 32 is about 0.2 mm at the maximum.

The maximum height (hereinafter referred to as "Ry" as well), which is obtained with a sampling length of 0.8 mm and an evaluation length of 4 mm at the cavity surface of the fixed die 12, is set to be not more than 16 μm.

Figure 3:
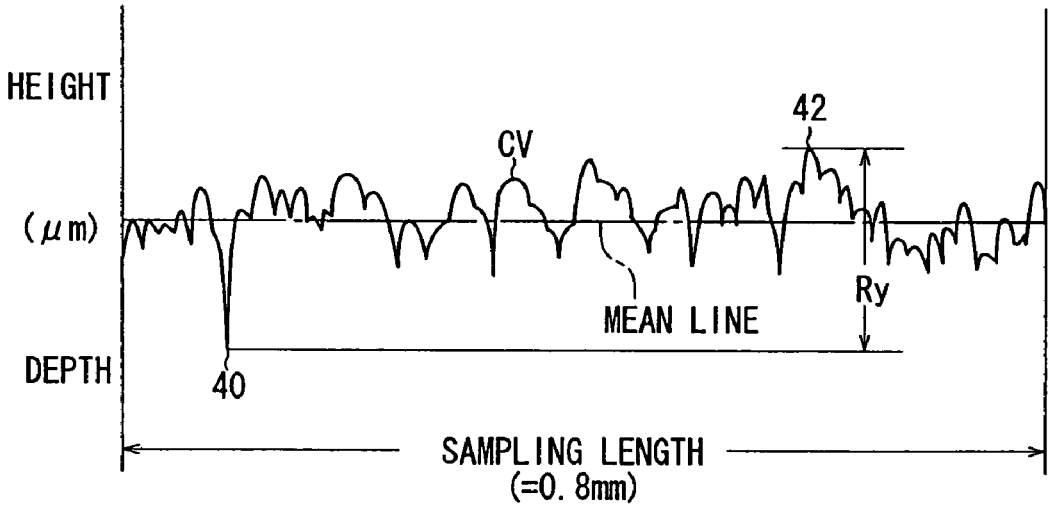
FIG. 3 explains the definition of maximum height.

Ry is determined as defined in JIS B 0601-2001, which is an index to express the roughness of the cavity surface. That is, as shown in FIG. 3, when a portion of the roughness profile CV to represent the minute irregularities of the cavity surface is sampled or extracted in an amount corresponding to the sampling length in the direction of the mean line, Ry represents the difference in height between the lowest valley 40 and the highest peak 42 of the extracted portion.

As described above, the sampling length is 0.8 mm and the evaluation length is 4 mm in this embodiment. The mean line is a straight line determined by the least square method on the basis of the depths of the respective valleys and the heights of the respective peaks within the sampling length of 0.8 mm.

The fixed die 12, in which Ry at the cavity surface is not more than 16 μm, can be obtained by applying a shot peening treatment as described later on. Further, Ry of the cavity surface can be made to 8 μm or less as well by performing the shot peening treatment twice.

The compressive residual stress is larger than 1000 MPa in the fixed die 12 to which the shot peening treatment has been applied. In particular, when the shot peening treatment is performed twice, the compressive residual stress exhibits a value larger than 1200 MPa.

The respective cavity surfaces of the side movable dies 14, 16 and the upper movable die 18 may also be constructed in the same manner as described above.

The fixed die 12, which is constructed as described above, can be obtained as follows. That is, first, starting from the SCM420 material as a raw material, the fixed die 12 is manufactured in accordance with a known processing method.

Subsequently, the shot peening treatment for coarse processing is applied to the cavity surface of the fixed die 12 in a first shot peening step. Specifically, water including ceramic particles having particle diameters of 200 to 220 meshes is allowed to collide against the cavity surface. In this procedure, the following condition may be available. For example, the discharge pressure of a pump for discharging the water containing the ceramic particles is 0.39 to 0.59 MPa (4 to 6 kgf/cm$^2$), and the ceramic particles make the collision for 5 to 10 seconds per 5 cm$^2$ of the cavity surface. Accordingly, the compressive stress of about 1.5 to 2.0 MPa (15 to 20 kgf/cm$^2$) is applied to the cavity surface.

As a result of the first shot peening step, Ry of the cavity surface is about 12 to 16 μm, and the compressive residual stress is 1000 MPa.

Subsequently, the fixed die 12, which has undergone the first shot peening step, is accommodated in a processing chamber to apply a sulphonitriding treatment. That is, the temperature in the processing chamber is maintained at 505° to 580° C., preferably about 570° C. After that, ammonia gas, hydrogen sulfide gas, and hydrogen gas are supplied into the processing chamber. The nitrogen atom as the constitutive element of the ammonia gas and the sulfur atom as the constitutive element of the hydrogen sulfide are diffused and bonded with respect to Fe as the constitutive element of the SCM420 material (fixed die 12). Accordingly, iron nitride and iron sulfide are produced. As a result, the sulphonitrided layer 32 is formed.

As described above, the cavity surface has been smoothened by means of the first shot peening treatment. Further, the compressive stress is applied to the cavity surface. Therefore, the nitrogen atom and the sulfur atom are bonded to Fe with ease when the sulphonitriding treatment is applied. That is, the sulphonitriding is advanced with ease.

The hydrogen gas is a component to control the activities of the ammonia gas and the hydrogen sulfide gas. It is possible to prevent the SCM420 material from being corroded by the ammonia gas by supplying the predetermined amount of hydrogen gas.

Subsequently, a shot peening treatment for finishing processing is applied to the cavity surface of the fixed die 12 in a second shot peening step. The second shot peening step may be performed under a condition that water including glass particles having particle diameters of 200 to 220 meshes, makes the collision for 5 to 10 seconds per 5 cm$^2$ of the cavity surface, while the discharge pressure of the pump is, for example, 0.29 to 0.49 MPa (3 to 5 kgf/cm$^2$).

As a result of the second shot peening step, Ry of the cavity surface is about 4 to 8 μm, and the compressive residual stress is larger than 1200 MPa.

Thus, the fixed die 12 is consequently obtained, in which the sulphonitrided layer 32 is provided at the cavity surface, Ry of the cavity surface is not more than 8 μm, and the compressive residual stress is larger than 1200 MPa. Of course, when the same or equivalent surface treatment is applied to the respective cavity surfaces of the side movable dies 14, 16 and the upper movable die 18, it is possible to construct the side movable dies 14, 16 and the upper movable die 18 having the cavity surfaces as described above.

The cylinder block is manufactured as follows by using the casting dies constructed as described above.

First, for example, molten metal such as aluminum is supplied into the cavity 24 via an unillustrated runner and an unillustrated gate, while the fixed die 12, the side movable dies 14, 16, and the upper movable die 18 are clamped as shown in FIG. 1. The supplied molten metal is cast with high pressure, i.e., at a pressure of about 85 MPa to 100 MPa.

During this process, even when the tensile stresses are exerted on the dies 12, 14, 16, 18 as the molten metal is supplied, the tensile stresses do not exceed the compressive residual stresses, because the compressive residual stresses of the fixed die 12, the side movable dies 14, 16, and the upper movable die 18 are remarkably large. Accordingly, the dies 12, 14, 16, 18 are excellent in the thermal shock resistance. Therefore, the heat crack in the dies 12, 14, 16, 18 is prevented, and hence the service lives of the dies 12, 14, 16, 18 are prolonged.

Further, the reaction between the aluminum (molten metal) and the respective dies 12, 14, 16, 18 is also prevented, because the sulphonitrided layer 32 is provided at each of the cavity surfaces.

The aluminum molten metal processed by the high pressure casting is solidified as the dies are cooled. After the completion of the solidification, the upper movable die 18 and the side movable dies 14, 16 are separated from the fixed die 12 to open the dies. Subsequently, the cast product, i.e., the cylinder block is taken out by using an unillustrated knockout pin.

During this process, the cutting of the cavity surface, which would be otherwise caused by the sliding contact with the cast product, is remarkably prevented, because the Vickers hardness of each of the cavity surfaces is not less than 700 because of the sulphonitrided layer 32. That is, the cavity surfaces are prevented from the chipping.

Further, in this procedure, the frictional resistance between the cylinder block and the cavity surface is remarkably small, because the iron sulfide is contained in the sulphonitrided layer 32. Therefore, any appearance of the scuffing or galling can be prevented as well.

When the casting operation is repeated, the compressive residual stress of each of the dies 12, 14, 16, 18 is progressively decreased. Therefore, heat cracks will appear in the dies 12, 14, 16 18 at some time with sufficient repeated use. In order to avoid this inconvenience, the first shot peening treatment, the sulphonitriding treatment, and the second shot peening treatment may be applied again as described above to the dies 12, 14, 16, 18 in each of which the compressive residual stress has been decreased. Accordingly, it is possible to increase the compressive residual stress of each of the dies 12, 14, 16, 18 again. Thus, it is possible to further prolong the period of time until a heat crack appears.

That is, the surface treatment method according to the embodiment of the present invention is applicable not only to the dies 12, 14, 16, 18 before being used for the casting operation but also to the dies 12, 14, 16, 18 in each of which the compressive residual stress is lowered as a result of the repeated use for the casting operation. Accordingly, it is possible to further prolong the service life of each of the dies 12, 14, 16, 18.

As described above, the service life of each of the dies 12, 14, 16, 18 can be prolonged by applying the shot peening treatment and the nitriding treatment to the dies 12, 14, 16, 18. Therefore, the replacement frequency of each of the dies 12, 14, 16, 18 is decreased to be as low as possible. Thus, it is possible to reduce the production cost of the cylinder block as the cast product.

In the embodiment of the present invention, the shot peening treatment is performed twice. However, the shot peening treatment may be performed once. In this procedure, the shot peening treatment may be performed after performing the sulphonitriding treatment.

It goes without saying that the shot peening treatment and the nitriding treatment may be applied to the entire surfaces as well as the cavity surfaces of the fixed die 12, the side movable dies 14, 16, and the upper movable die 18.

The foregoing embodiment has been explained as exemplified by the casting die of the SCM420 material. However, there is no special limitation thereto. The present invention is applicable to any casting die provided that the casting die is made of a steel material. For example, the present invention is also applicable to a casting die of a SKD61 material. In this case, the sufficient thickness of the sulphonitrided layer 32 is 0.03 mm.

The sulphonitrided layer 32 may be obtained such that a compound layer of iron sulfide and iron nitride is formed on the diffusion layer. In this case, the thickness of the compound layer is preferably not more than 6 μm in order to avoid the increase in brittleness.

A nitrided layer may be provided in place of the sulphonitrided layer 32 by adopting the gas nitriding in place of the sulphonitriding.

As explained above, the compressive residual stress remains and the nitrided layer is formed at the cavity surface by applying the shot peening treatment and the nitriding treatment to at least the cavity surface of the casting die of the steel material. Accordingly, the thermal shock resistance is improved, and the surface of the casting die becomes hard. Therefore, the heat crack and the chipping scarcely appear in the casting die, and hence the service life of the casting die is remarkably prolonged. That is, the replacement frequency of the casting die is reduced. Consequently, it is possible to reduce the production cost of the cast product.

Although there has been described what are the present embodiments of the invention, it will be understood that modifications and variations may be made thereto within the spirit and scope of the invention as reflected in the appended claims.

The invention claimed is:

1. A surface treatment method of a casting die made of a steel material, said method comprising the steps of:

applying a first shot peening treatment to at least a cavity surface of said casting die, so that a maximum height of roughness of said casting die is not more than 16 μm, and a compressive residual stress of said casting die is 1000 MPa or larger after the first shot peening and before a sulphonitriding treatment, applying a sulphonitriding treatment after applying said first shot peening treatment, and applying a second shot peening treatment after applying said sulphonitriding treatment to said at least the cavity surface of said casting die, so that a maximum height of roughness of said cavity surface is not more than 8 μm, and the compressive residual stress is larger than 1200 MPa after the second shot peening treatment, wherein each of said shot peening treatments is performed for a time period ranging from 5 seconds to 10 seconds.

2. The surface treatment method of said casting die according to claim 1, wherein said surface treatment method is applied to said casting die after the die has been used for casting operation.

3. The surface treatment method of said casting die according to claim 1, wherein hydrogen gas is applied to said cavity surface during said nitriding treatment.

4. The surface treatment method of said casting die according to claim 1, wherein ammonia gas, hydrogen sulfide gas, and hydrogen gas are applied to said cavity surface during said nitriding treatment to form a compound diffusion layer containing both iron sulfide and iron nitride.

5. The surface treatment method of said casting die according to claim 1, wherein said first shot peening step involves discharge of water containing ceramic particles of 200-220 mesh at a pump discharge pressure of 0.39-0.59 MPa such that the ceramic particles collide against the cavity surface for 5-10 seconds, and said second shot peening step involves discharge of water containing glass particles of 200-220 mesh at a pump discharge pressure of 0.29-0.49 MPa such that the ceramic particles collide against the cavity surface for 5-10 seconds.

6. The surface treatment method of said casting die according to claim 1, wherein said steel material is an SCM chrome molybdenum steel material and after said second shot peening treatment said at least the cavity surface of said casting die has a hardness of at least 700 Vickers hardness.

7. The surface treatment method of said casting die according to claim 1, wherein said sulphonitriding treatment step is performed in a processing chamber under controlled temperature in a range between 505 degrees Celsius and 580 degrees Celsius.

8. The surface treatment method of said casting die according to claim 1, wherein said steel material is SCM420 chrome molybdenum steel material and after said second shot peening teatment said at least the cavity surface of said casting die has a hardness of at least 700 Vickers hardness.

9. A steel die for use in casting metal workpieces, the die having a cavity surface formed therein and being a product of a process comprising the steps of:

a) performing a coarse peening step, such that a maximum height of roughness of said cavity surface is not more than 16 μm and the compressive residual stress of the die is 1000 MPa or larger after the coarse peening step and before a sulphonitriding treatment;

b) after the coarse peening step, applying a gaseous mixture comprising a sulfurizing gas and a nitriding gas to the cavity surface of the die in a sulphonitriding treatment performed in a processing chamber under controlled temperature conditions to form a sulphonitrided diffusion layer on said cavity surface; and c) subsequently, performing a finishing peening step;

wherein, after the finishing peening step, a residual stress of the cavity surface is larger than 1200 Mpa, and the maximum height of roughness of the cavity surface is not more than 8 μm.

10. The steel die of claim 9, wherein the coarse peening step comprises applying water-borne ceramic particles to the cavity surface of the die, the ceramic particles having particle diameters between 200 and 220 mesh, and wherein the finishing peening step comprises applying water-borne glass particles to the cavity surface of the die, the glass particles having particle diameters between 200 and 220 mesh.

11. The steel die of claim 9, wherein the temperature in the processing chamber is maintained in a range between 505 degrees Celsius and 580 degrees Celsius during the gaseous mixture application step.

12. The steel die of claim 9, wherein the gaseous mixture comprises ammonia gas, hydrogen sulfide gas, and hydrogen gas.

13. The steel die of claim 9, wherein said coarse peening step involves discharge of water containing ceramic particles of 200-220 mesh at a pump discharge pressure of 0.39-0.59 MPa such that the ceramic particles collide against the cavity surface for 5-10 seconds, and said finishing peening step involves discharge of water containing glass particles of 200-220 mesh at a pump discharge pressure of 0.29-0.49 MPa such that the ceramic particles collide against the cavity surface for 5-10 seconds.

14. The steel die of claim 9, wherein said die is formed of an SCM chrome molybdenum steel material and after said finishing shot peening step said cavity surface of said casting die has a hardness of at least 700 Vickers hardness.

15. The steel die of claim 9, wherein said die is formed of SCM420 chrome molybdenum steel material and after said finishing shot peening step said cavity surface of said casting die has a hardness of at least 700 Vickers hardness.

* * * * *